US007316588B1

(12) United States Patent
Rogers et al.

(10) Patent No.: US 7,316,588 B1
(45) Date of Patent: Jan. 8, 2008

(54) UNITARY MULTI-POLE CONNECTOR

(75) Inventors: Frederick C. Rogers, Olathe, KS (US); Lyle T. Bertz, Lee's Summit, MO (US); Usman Muhammad Naim, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 0 days.

(21) Appl. No.: 11/534,884

(22) Filed: Sep. 25, 2006

(51) Int. Cl.
*H01R 24/04* (2006.01)

(52) U.S. Cl. ..... 439/668; 439/669; 439/924.1

(58) Field of Classification Search ..... 439/668, 439/669, 924.1
See application file for complete search history.

(56) References Cited

U.S. PATENT DOCUMENTS 3,665,509 A * 5/1972 Elkins ..... 439/42
6,394,852 B1 * 5/2002 Huang ..... 439/669
6,595,804 B2 * 7/2003 Nagata ..... 439/668
6,764,347 B1 * 7/2004 Plishner ..... 439/668
6,945,803 B2 * 9/2005 Potega ..... 439/218
2006/0030219 A1 * 2/2006 Huang ..... 439/669

FOREIGN PATENT DOCUMENTS

DE 3605076 A1 * 8/1987

* cited by examiner

*Primary Examiner*—Tho D. Ta

(57) ABSTRACT

A unitary connector system includes a single pin, multi-pole electrical connector having a plug body, as well as a mating receptacle. The plug body is formed of a series of discrete conductive contacts interposed with a series of insulative rings such that the insulative rings electrically isolate adjacent conductive contacts from one another, each contact thereby forming a terminal. A series of conductive lines extend within the plug body and are electrically coupled with the series of conductive contacts each representing a transmission channel. The universal nature of the plug body design allows for a specific number of poles to be chosen to handle the particular signal transmission requirements.

10 Claims, 3 Drawing Sheets

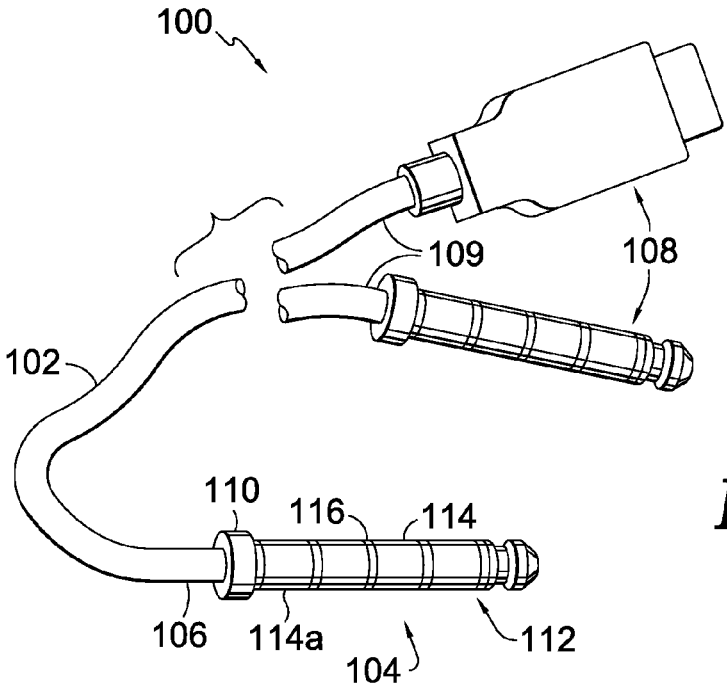
FIG. 1.
FIG. 2.
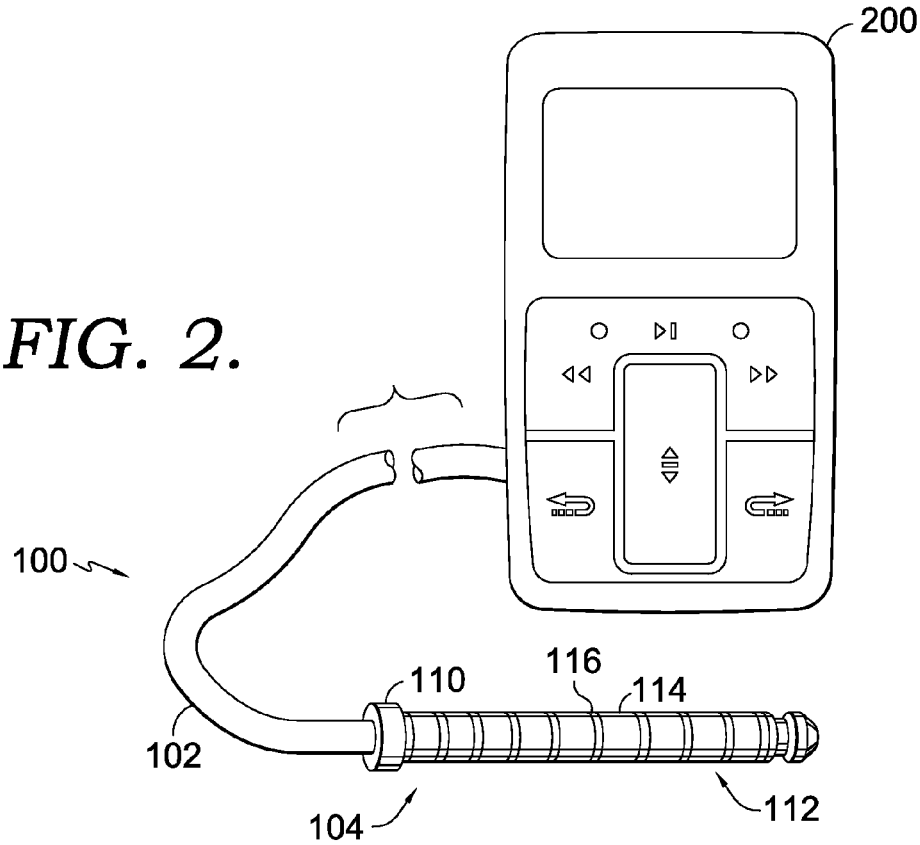

UNITARY MULTI-POLE CONNECTOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Interconnectivity between electronic devices is commonly accomplished through a connector arrangement in non-wireless signal transmission situations. One type of conventional connector system employs a single or multi-prong conductive male element, or "plug" mating with a receptacle of an electronic device having corresponding conductive terminals. These connector systems are typically utilized to interconnect audio and/or video equipment, such as televisions, stereo equipment, DVD players, etc. Each conductive contact, or terminal, on the plug represents a dedicated channel for delivering a specific type of signal from a first device coupled with the plug through cabling to a second device having the receptacle. For instance, the channels may include audio left and right channels, as well as a ground. Individual pins of certain plug also can serve as channels to transmit a video signal as composite components, such as color and luminance, which are then delivered to the receptacle where circuitry of the device recombines the signals from the channels into a representative video signal. Other types of conventional connector systems utilize a plug and receptacle arrangement, but with recessed conductive terminals formed on the plug instead of projecting prongs. Examples of these types of connector systems include universal serial bus (USB) connectors and Firewire® connectors of Apple Computer, Inc., which are often utilized to interconnect components of a computing system (e.g., input/output devices with computer hardware) but also have found use in interfacing audio and/or video equipment with a computing system. Plug-type connectors have a series of conductive lines or cabling attached to the terminals within a body of the plug, with the cabling typically extending away from the plug inside of a cable sheath to the associated electronic device Depending on the particular application, conventional connector systems can have a number of drawbacks. As an example, the individual prongs or recessed terminals of plug-type connectors can be fragile and subject to breakage if the plug is not in proper rotational alignment with respect to the mating receptacle upon insertion. Additionally, the relatively small form factor of multi-prong connectors (as well as USB connectors and the like) typically results in the conductive terminals of the plug and/or receptacle having durability issues after numerous cycles of mating between the connector elements.

BRIEF SUMMARY

A unitary multi-pole connector system is provided for improved universal connectivity between electronic devices. In one aspect, the connector system includes a single pin, multi-pole electrical connector formed by a hollow plug body and a series of conductive lines. The plug body is formed of a series of discrete conductive contacts interposed with a series of insulative rings such that the insulative rings electrically isolate adjacent conductive contacts from one another, each contact thereby forming a terminal. The series of conductive lines extend within the plug body and are electrically coupled with the series of conductive contacts. In this arrangement, the conductive lines may be coupled with a first electronic device on an end distal to the plug body, such that when the plug body is inserted into a mating receptacle or receptacle of a second electronic device, electrical signals may be transmitted between the first and second devices over a wired medium.

The multi-pole connector provides for a plurality of transmission channels through the conductive contact terminals. In one aspect, the channels may include audio left and right channels, a composite video channel, a microphone channel, an audio/video ground, and optionally, additional channels. In another aspect, the channels may form a data bus with an integer multiple of four or eight discrete conductive pathways for the transmission of data, including a ground. Optionally, an electrical power channel may be present along with the data bus.

Additional advantages and features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

The present invention is described in detail below with reference to the attached drawing figures, wherein:

FIG. 1 is schematic view of a unitary multi-pole connector of one embodiment of the present invention formed at one end of electrical cabling and an optional electrical connector formed at the opposite end of the electrical cabling;

FIG. 2 is a schematic view of a unitary multi-pole connector of one embodiment of the present invention formed at one end of electrical cabling and an electronic device coupled with the opposite end of the electrical cabling;

DETAILED DESCRIPTION

Figure 3:
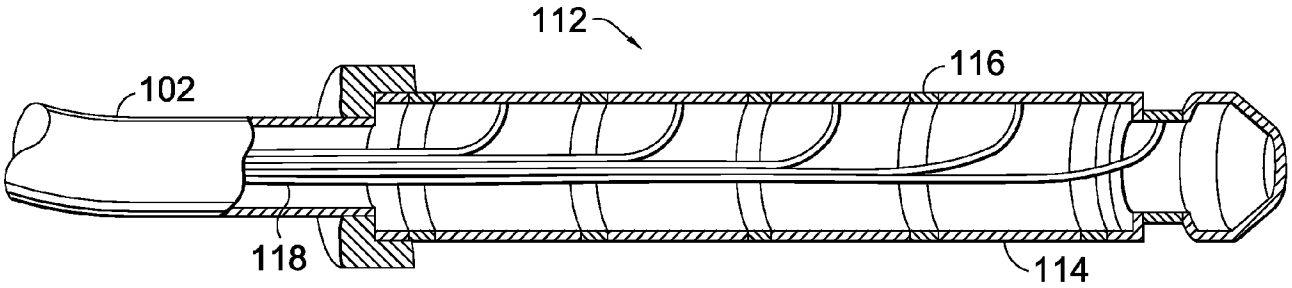
FIG. 3 is a sectional view of the unitary multi-pole connector of one embodiment of the present invention showing a series of conductive lines within the plug body.

Embodiments of the present invention relate to a unitary multi-pole connector system. The system employs a single pin plug body design to simplify the mechanical connections between conductive terminals of both the plug and the receptacle that are required to electrically couple the connector elements together for signal transmission between interconnected devices. Furthermore, the universal nature of plug body design of the present invention allows for expansion of poles (corresponding to transmission channels) that is essentially only limited by the physical dimensions of the receptacle on the associated electronic device and the characteristics of the signals being transferred between the devices. The connector system can also be configured to carry signals of any type, including audio, video, and other data carrying signals, as well as electrical current for powering the operations of the electronic devices.

Turning to FIG. 1, one embodiment of a connector apparatus of the present invention is represented by reference numeral 100. The connector apparatus includes conductive cabling 102, a first plug body 104 extending from a first end 106 of the cabling 102, and a second plug body 108 extending from an opposed second end 108 of the cabling 102. The first plug body 104 is formed by a base collar 110 and a hollow cylindrical member 112 extending axially from the collar 110. The cylindrical member 112, or "pin member", is formed by alternating conductive contacts 114 and insulative rings 116, such that each insulative ring 116 electrically isolates adjacent discrete conductive contacts 114. The conductive contacts 114 are also referred to herein as "terminals" or "poles". Each conductive contact 114 of the series is associated with a transmission channel dedicated for transporting certain types of signals. Depending on how signals are transmitted by interconnected electronic devices, the channels may be either static or reconfigurable. With static channels, a single type of signal is always carried on a specific channel. For instance, a first conductive contact 114*a* may always deliver an "audio left" audio component to a corresponding receptacle terminal. With reconfigurable channels, a specific channel may carry different types of signals which are dependant on the transmission schemes of the electronic devices interconnected by the apparatus 100. As will be explained in further detail below, the cabling 102 houses conductive lines or wires electrically coupled with the conductive contacts 114 within the first plug body 104, so that transmitted signals are carried by the cabling 102 between the first and second plug bodies 104 and 108. The second plug body 108 may have the same structure as the first plug body 104, or alternatively, may have a conventional connector structure with the same number of transmission channels as the first plug body 104. For instance, the second plug body may take the form of a USB plug connector or any other type of plug connector. As can be appreciated, both the first and second plug bodies 104 and 108 can be fit into mating receptacles of respective electronic devices, such that the interconnected devices can transmit signals to one another. In another embodiment depicted in FIG. 2, the connector apparatus 100 can be formed without the second plug body 108 and instead have the cabling 102 hard wired directly with internal circuitry of an electronic device 200.

Figure 4:
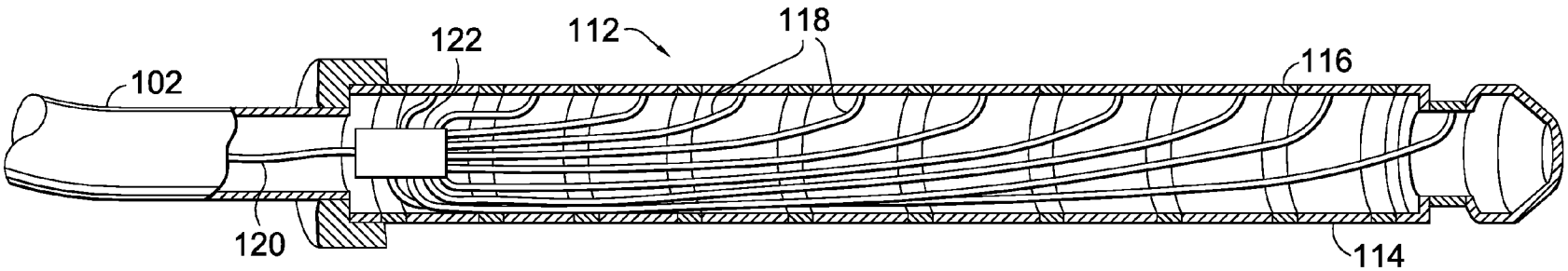
FIG. 4 is a sectional view of the unitary multi-pole connector of one embodiment of the present invention showing a series of conductive lines and circuitry for supporting signal modulation.

With reference to FIG. 3, a series of conductive lines or wires 118 extend within the cabling 102 and into the pin member 112 to be electrically coupled with the conductive contacts 114. Specifically, each conductive line 118 handles a transmission channel for delivering signals to a respective one of the conductive contacts 114. The terminal ends of the conductive lines 118 may be soldered to the conductive contacts 114 of the pin member 112, or connected by other means as those of skill in the art appreciate. In another embodiment represented in FIG. 4, a single, multi-frequency carrying conductive line 120 extends through the cabling 102 to an integrated circuit 122 housed within the plug body 104. The integrated circuit 122 is configured to handle modulation techniques present in the signals carried by the conductive line 120. For instance, the integrated circuit 122 may include a processor and associated memory for handling multiplexed signals delivered by the conductive line 120 from a first electronic device (e.g., device 200) by demultiplexing the signals into separate signal components for delivery to the conductive lines 118 connected therewith, which then carry the signals to the respective conductive contacts 114 of the plug body 104.

Figure 5:
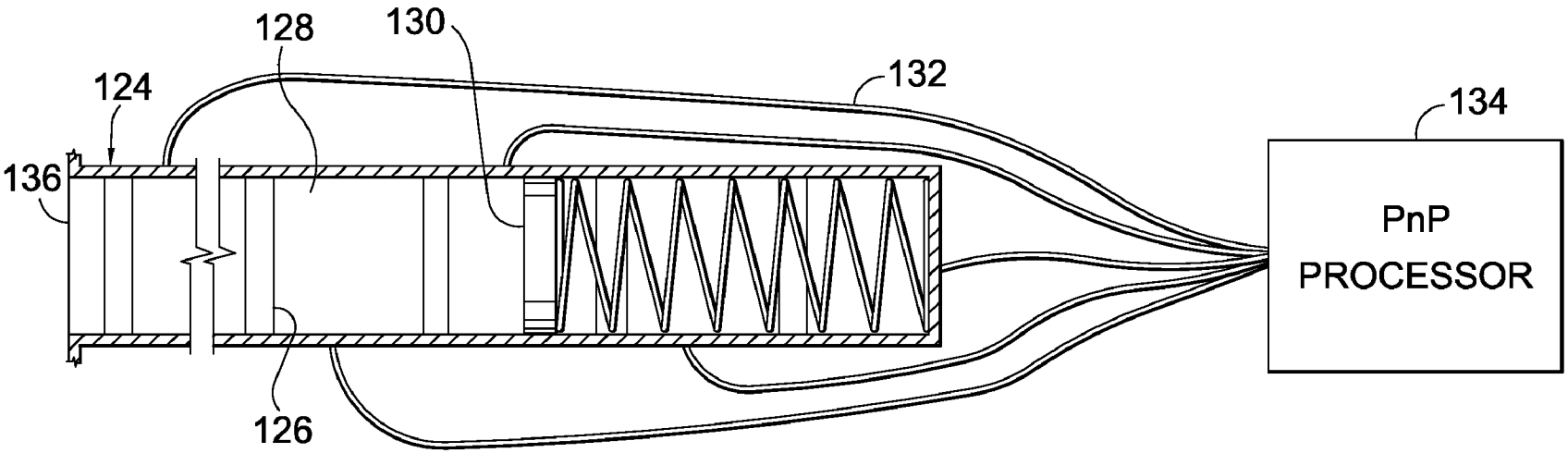
FIG. 5 is a sectional view of an electronic device receptacle of one embodiment of the present invention showing a series of conductive lines coupled with a plug-and-play processor.

One embodiment of a elongate receptacle 124 of the connector system is depicted in FIG. 5. The receptacle 124 may, for instance, be formed into an electronic device housing and electrically coupled with circuitry of the device. Similar to the plug body 104, the receptacle 124 has a series of alternating insulative rings 126 and conductive contacts or terminals 128, such that each insulative ring 126 electrically isolates adjacent discrete conductive contacts 128. Thus, when the plug body 104 (specifically the pin member 112) is inserted into the receptacle 124, the specific conductive contacts 114 of the plug 104 that are aligned with and contacting the conductive contacts 128 of the receptacle 124 are capable of transmitting signals therebetween. The signals that reach the receptacle contacts 128 are then relayed along conductive lines 132 to circuitry 134 of the electronic device (e.g., device 200) that houses the receptacle 124. A spring biased end plate 130 is also positioned within the receptacle 124 and functions as a conductive contact 128 by moving axially within the receptacle 124 towards an opening 136 thereof to contact a terminal end conductive contact 114 of the plug 104.

As previously mentioned, the transmission channels handled by the conductive lines 118 and 132 may be reconfigurable. This comes into play, for example, when specific conductive contacts 128 of the receptacle 124 receive different signal types depending on either the particular arrangement of conductive contacts 114 on the mating plug body 104 or on the configuration of the electronic device transmitting signals to the plug body 104 for reception by the receptacle 124. To handle reconfigurable channels, the circuitry 134 takes the form of a universal Plug-and-Play (PnP) processor. The processor 134 "listens" for a predefined type of signal (e.g., audio left) on any of channels associated with the receptacle contacts 128. Upon detecting such a signal type, the processor 134 notes the particular contact 128 position and its role (e.g., power, transmit, receive, etc.) based upon information in the received signals provided by an application run by the electronic device on the other end of the transmission system (i.e., on the other side of the plug body 104 from the receptacle 124). In this way, the processor 134 enables the electronic device associated with the receptacle 124 to properly handle signals that are received by the device from another device while also transmitting signals requested by the other device.

The universal nature of the single pin design of the plug body 104 allows for numerous poles to be formed on a single plug body. In general, the larger the surface area of mating contact between conductive contacts 114 and 128 of the plug body 104 and receptacle 124, respectively, the higher the rate of transmission for the signals that can be handled by the multi-pole connector system. Additionally, the diameter of the pin member and receptacle 124 can effect how signals on different channels provide interference to one another. Thus, in certain data transmission applications, the plug body 104 and receptacle 124 should be sized to accommodate the expected bandwidth necessary for proper signal handling. Preferably, at least five conductive contacts 114 and 128 are present on the plug body 104 and receptacle 124, respectively. In one embodiment, the transmission channels associated with the conductive contacts 114 and 128 include at least an audio left channel, an audio right channel, a video channel, a microphone channel, and an audio/video ground. In another embodiment, the transmission channels form a data bus with an integer multiple of four or eight discrete conductive pathways for the transmission of data, as well as a ground. With such a data bus, each channel may transmit at a different line rate, similar to a universal serial bus or other similar connection scheme. Optionally, an electrical power channel may be present along with the data bus.

It should also be understood that although the pin member 112 of the plug body 104 is ideally cylindrical, the particular cross-sectional shape of the pin member 112 may not represent a true circle, but could be elliptical for example. The particular cross-sectional shape should be one that is compatible with the intended receptacle 124 cross-sectional shape, so that conductive contacts 114 and 128 of the plug body 104 and receptacle 124 properly engage with one another for electrical coupling therebetween.

The aforementioned system has been described in relation to particular embodiments, which are intended in all respects to be illustrative rather than restrictive. Since certain changes may be made in the aforementioned system without departing from the scope hereof, it is intended that all matter contained in the above description or shown in the accompanying drawings be interpreted as illustrative and not in a limiting sense.

What is claimed is:

1. A single pin, multi-pole electrical connector, comprising:

a generally cylindrical hollow plug body formed of a series of at least N number of discrete conductive contacts interposed with a series of insulative rings for electrical isolating the conductive contacts of the series of at least N number of conductive contacts from one another;

a series of N number of conductive lines extending within the plug body and electrically coupled with the series of conductive contacts, each conductive line being associated with one of the conductive contacts;

an integrated circuit configured for supporting signal modulation techniques and electrically coupled with the conductive lines; and a primary conductive line electrically coupled with the integrated circuit for transmitting a modulated signal to the integrated circuit;

wherein N represents a number that is 5 or greater.

2. A connector apparatus for transporting electrical signals from a first electronic device to a second electronic device, comprising:

a first plug-type connector formed as a hollow single pin member including a series of discrete conductive contacts interposed with a series of insulative rings for electrical isolating the conductive contacts of the series of conductive contacts from one another, wherein the series of conductive contacts includes at least 5 conductive contacts;

a second connector; and a series of conductive lines electrically coupled with the series of conductive contacts within the pin member of the first connector and extending between the first connector and the second connector.

3. The apparatus of claim 2, wherein the second connector comprises a plug-type connector formed as a hollow single pin member including a series of discrete conductive contacts interposed with a series of insulative rings for electrical isolating the conductive contacts of the series of conductive contacts from one another, wherein the series of conductive contacts of the second connector includes at least 5 conductive contacts.

4. The apparatus of claim 2, wherein the series of conductive lines comprises N number conductive lines each associated with one of the conductive contacts of the first connector, the apparatus further comprising:

an integrated circuit configured for supporting signal modulation techniques and electrically coupled with the conductive lines; and a primary conductive line electrically coupled with the integrated circuit and with the second connector for transmitting a modulated signal between the integrated circuit and the second connector.

5. A method of transporting electrical signals from a first electronic device to a second electronic device, comprising:

providing a first plug-type connector formed as a hollow single pin member including a series of discrete conductive contacts interposed with a series of insulative rings for electrical isolating the conductive contacts of the series of conductive contacts from one another, wherein the series of conductive contacts includes at least 5 conductive contacts;

providing a conductive line set having a first end region and a second end region, the first end region being electrically coupled with the series of conductive contacts within the pin member of the first connector;

providing a second connector electrically coupled with the second end region of the conductive line set;

releasably securing the first connector with the first electronic device to form an electronic coupling therebetween;

releasably securing the second connector with the second electronic device to form an electronic coupling therebetween;

transmitting, by one of the first electronic device and the second electronic device, electronic signals to the other of the first electronic device and the second electronic device through the conductive line set, wherein the electronic signals are formed as series of dedicated channels, each channel associated with one conductive contact of the series of conductive contacts.

6. The method of claim 5, wherein the series of channels comprise at least:

an audio left channel;

an audio right channel;

a video channel;

a microphone channel; and an audio/video ground.

7. The method of claim 5, further comprising a receptacle formed on the first electronic device, wherein the step of releasably securing the first connector with the first electronic device includes inserting the first connector into the first electronic device receptacle.

8. The method of claim 5, wherein the second connector comprises a plug-type connector formed as a hollow single pin member including a series of discrete conductive contacts interposed with a series of insulative rings for electrical isolating the conductive contacts of the series of conductive contacts from one another, wherein the series of conductive contacts of the second connector includes at least 5 conductive contacts.

9. The method of claim 5, wherein the series of channels comprise at least:

an integer multiple of 4 channel data bus; and a ground.

10. The method of claim 9, wherein the series of channels further comprise a electrical power channel.

* * * * *